US008500112B2

(12) United States Patent
Fan

(10) Patent No.: US 8,500,112 B2
(45) Date of Patent: Aug. 6, 2013

(54) PRINTED MATERIAL HOLDING DEVICE AND PRINTER WITH THE PRINTED MATERIAL HOLDING DEVICE

(75) Inventor: Chen-Lu Fan, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 375 days.

(21) Appl. No.: 12/979,066

(22) Filed: Dec. 27, 2010

(65) Prior Publication Data

US 2011/0299906 A1 Dec. 8, 2011

(30) Foreign Application Priority Data

Jun. 7, 2010 (CN) ..... 2010 1 0193422

(51) Int. Cl.
*B65H 37/04* (2006.01)

(52) U.S. Cl.
USPC ..... 270/58.08; 271/207

(58) Field of Classification Search
USPC ..... 271/207; 270/58.08, 58.11, 58.12, 270/58.18
See application file for complete search history.

(56) References Cited

U.S. PATENT DOCUMENTS

| | | | | |
|---|---|---|---|---|
| 4,155,643 | A * | 5/1979 | Ladds et al. | 355/72 |
| 5,172,908 | A * | 12/1992 | Steinhilber | 271/288 |
| 6,246,926 | B1 * | 6/2001 | Ishii et al. | 700/223 |
| 7,556,261 | B2 * | 7/2009 | Luquet et al. | 271/207 |
| 7,568,694 | B2 * | 8/2009 | Sparer et al. | 271/207 |
| 2005/0275157 | A1 * | 12/2005 | Mindler et al. | 271/207 |
| 2008/0023909 | A1 * | 1/2008 | Justice et al. | 271/207 |

* cited by examiner

*Primary Examiner* — Patrick Mackey
(74) *Attorney, Agent, or Firm* — Altis Law Group, Inc.

(57) ABSTRACT

A printed material holding device includes a printed material tray for receiving printed material and a transmission mechanism. A first claw is disposed on the printed material tray. The transmission mechanism includes a mounting plate attached to a main body of a printer. A clipping hole is defined in the mounting plate. The first claw is configured to move between a first configuration, where the first claw is engaged in the clipping hole, so that printed material tray is secured to the mounting plate, and a second configuration, where the first claw is disengaged from the clipping hole, so that the printed material tray is withdrawn from the mounting plate.

17 Claims, 11 Drawing Sheets

PRINTED MATERIAL HOLDING DEVICE AND PRINTER WITH THE PRINTED MATERIAL HOLDING DEVICE

CROSS-REFERENCE TO RELATED APPLICATIONS

This application are related to co-pending application entitled, "PRINTED MATERIAL HOLDING DEVICE AND PRINTER WITH THE PRINTED MATERIAL HOLDING DEVICE," filed on Dec. 24, 2010, application Ser. No. 12/978, 507, and "PRINTED MATERIAL HOLDING DEVICE AND PRINTER WITH THE PRINTED MATERIAL HOLDING DEVICE," filed on Dec. 27, 2010, application Ser. No. 12/979,074.

BACKGROUND

1. Technical Field

The present disclosure relates to a printed material holding device for receiving printed sheet printed material and a printer with the printed material holding device.

2. Description of Related Art

Many printers include a main body and a printed material tray secured to the main body. The printed material tray is located outside of the main body. However, the printed material tray cannot be removed from the main body. Therefore, it is inconvenient to relocate the printer.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
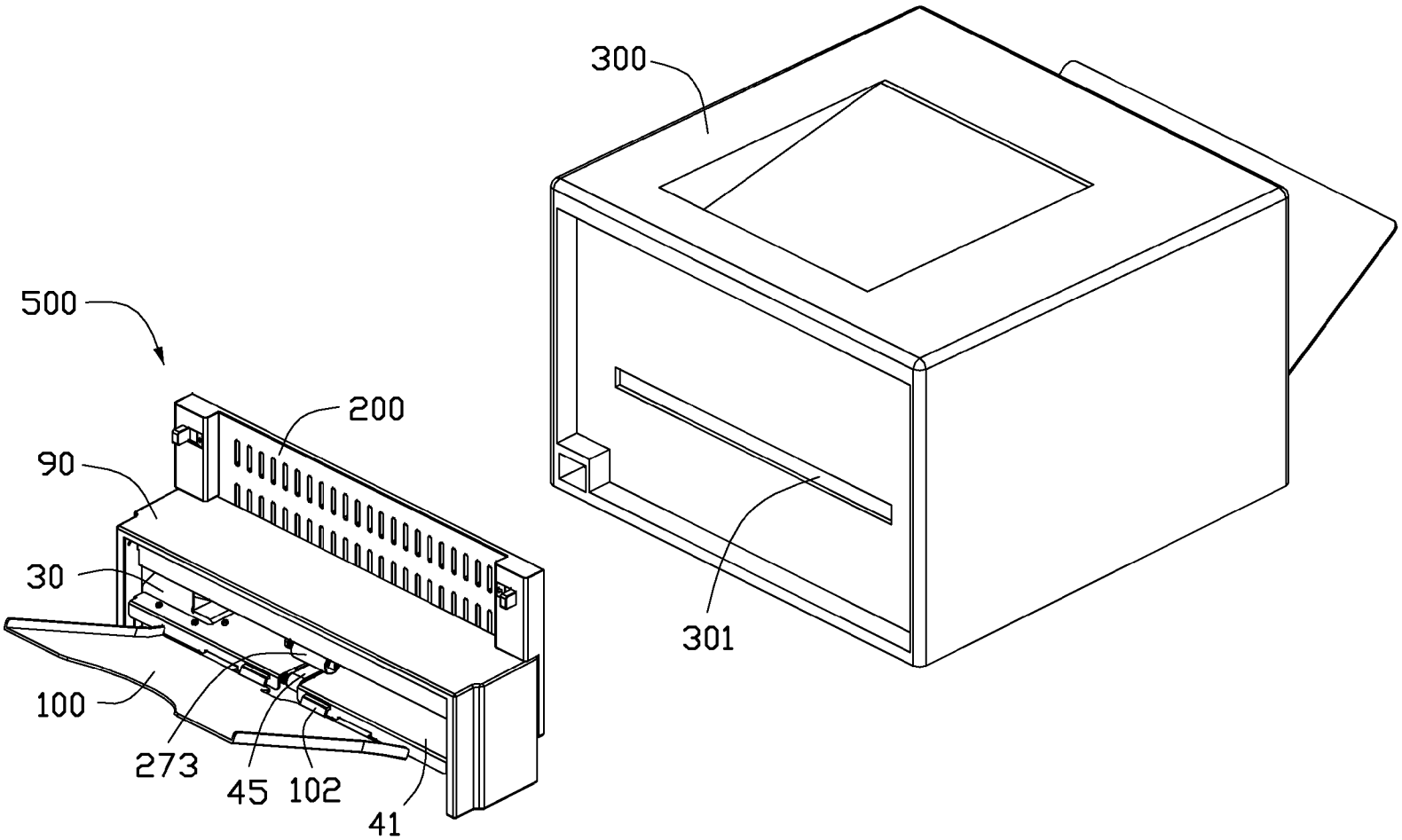
FIG. 1 is an exploded, isometric view of a printer in accordance with one embodiment.

Referring to FIG. 1, a printer as disclosed includes a main body 300 and a printed material holding device 500 attachable to the main body 300.

The main body 300 is used to print documents and outputting sheet printed material and an output opening 301 is defined in a rear wall (not labeled) of the main body 300, for outputting the printed media.

The printed material holding device 500 includes a mounting member 200, a receiving tray 90 secured to the mounting tray 11, a management center 400 (shown in FIG. 2) received in the receiving tray 90, and a printed material tray 100. The mounting member 200 is configured to secure to the rear wall of the main boy 300. Two catches 201 (shown in FIG. 10) are located on two opposite sides of the mounting member 200.

Figure 2:
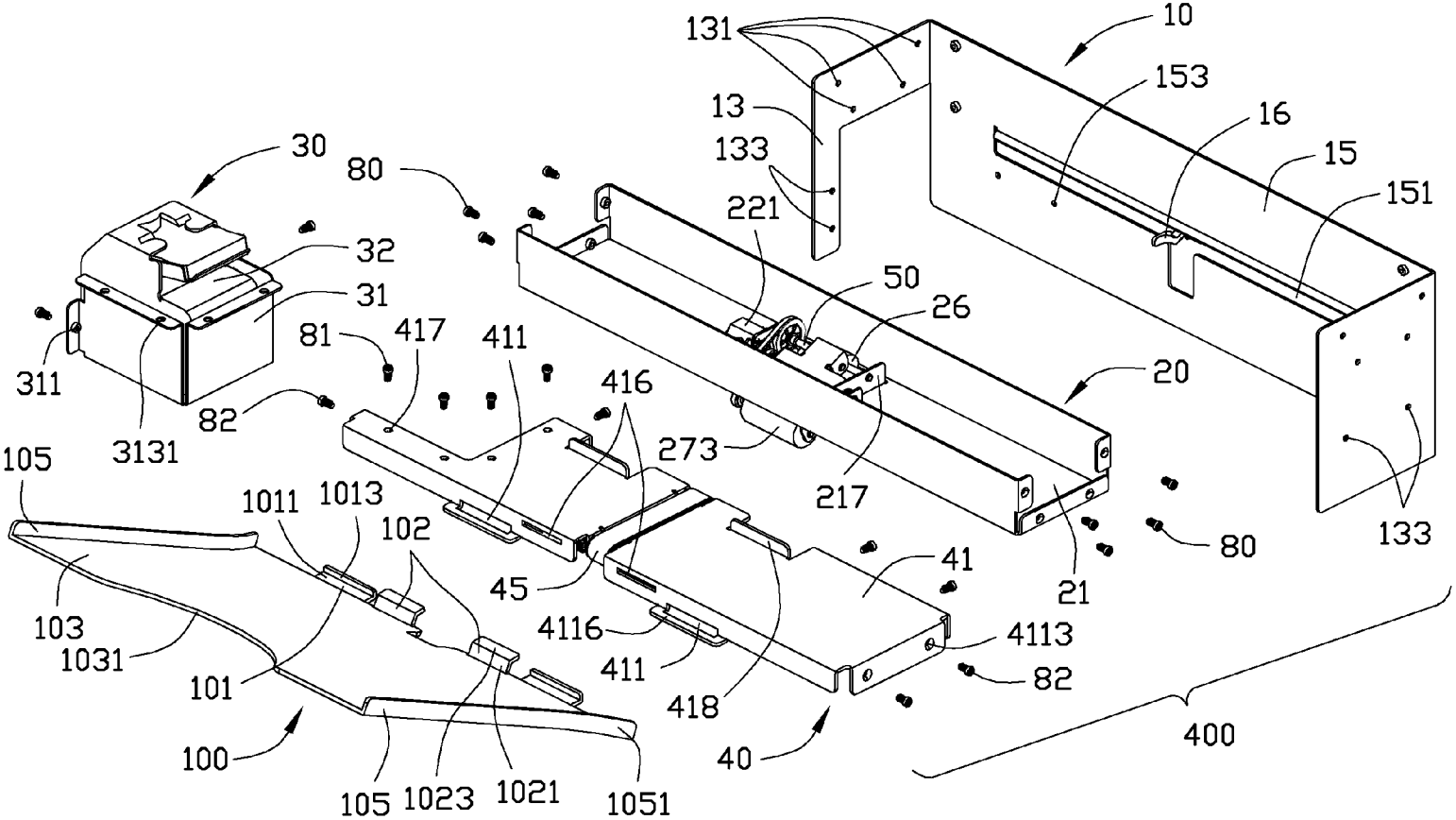
FIG. 2 is a partly exploded view of a printed material holding device of FIG. 1.
Figure 3:
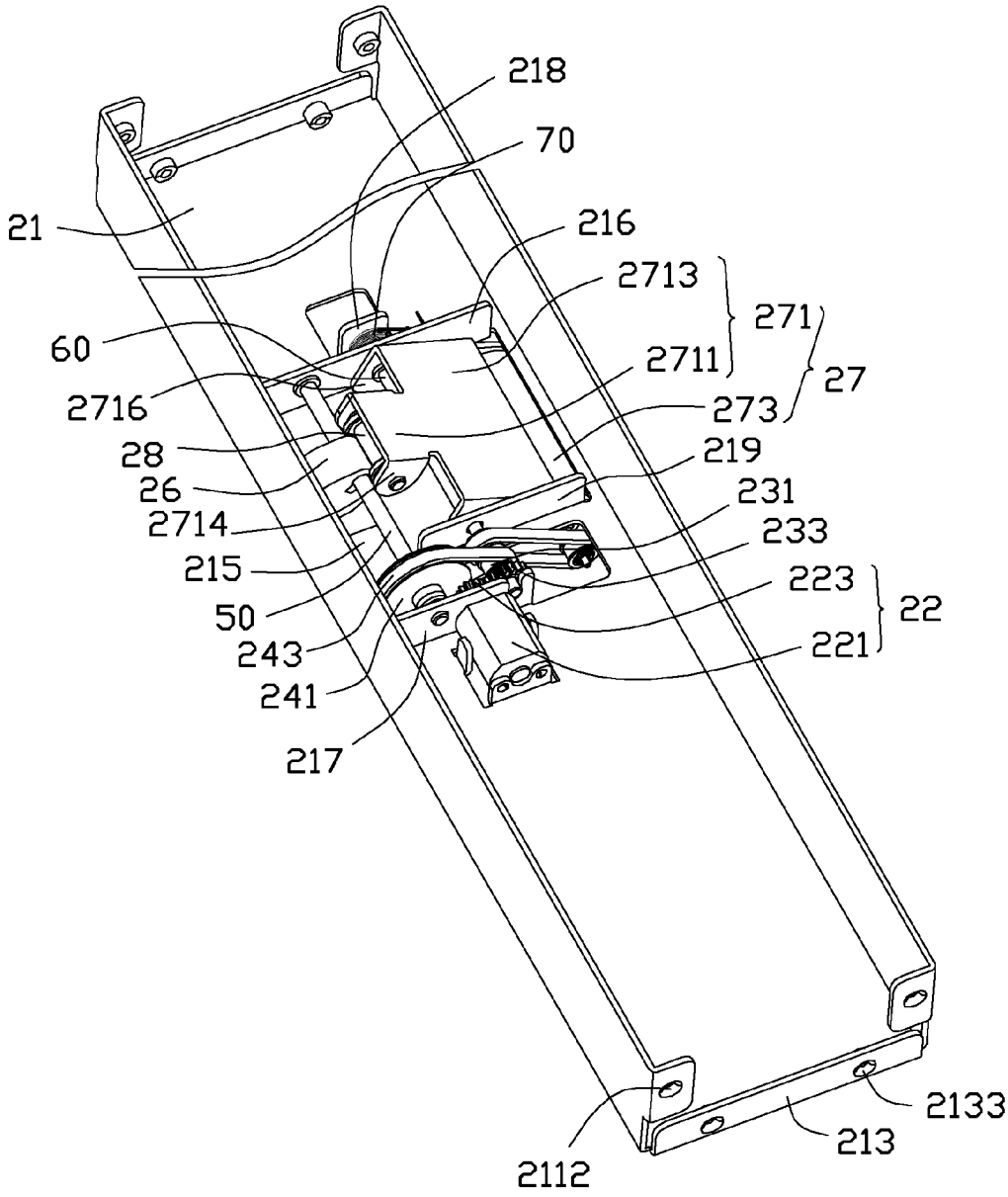
FIG. 3 an isometric view of an adjustable mechanism of FIG. 2, showing a moving member of the adjustable mechanism in a first position.

Referring to FIGS. 2-3, the management center 400 includes a bracket 10, an adjustable mechanism 20, a binding mechanism 30, and a transmission mechanism 40.

The bracket 10 includes a rear panel 15 and two side panels 13 connected to two short edges of the rear panel 15. A gap 151 is horizontally defined in the rear panel 15, corresponding to the output opening 301. A sensor 16, located on the rear panel 15 in the gap 151, is configured to start the adjustable mechanism 20, the binding mechanism 30, and the transmission mechanism 40 by detecting media. A number of fastening holes 153 are defined in the rear panel 15, adjacent to the gap 151. A number of securing holes 131 and fixing holes 133 are defined in each side panel 13. In one embodiment, the two side panels 13 are substantially parallel to each other and substantially perpendicular to the rear panel 15.

The adjustable mechanism 20 includes a box 21, a first driving device 22 received in the box 21, a transfer member 23 driven by the first driving device 22, a first gear assembly 24, a second gear assembly 25 driven by the first gear assembly 24, a rotatable member 26 driven by first gear assembly 24, and a moving member 27 driven by the rotatable member 26. In one embodiment, the rotatable member 26 is a cam that has a long radius portion and a short radius portion.

A number of the mounting holes 2112 are defined in two short opposite sides of the box 21, corresponding to the securing holes 131 of the bracket 10. An opening 215 is defined in the center of the box 21, and a first flange 216 and a second flange 217 are located on two opposite edges of the opening 215. A first retaining piece 218, adjacent to the second flange 217, is located on the box 21, and a second retaining piece 219, adjacent to a second flange 217, is located on the box 21.

The first driving device 22 includes a first motor 221 and a first driving gear member 223 attached to the first motor 221. The first motor 221 abuts an outside of the second flange 217, and the first driving gear member 223 abuts an inside of the second flange 217.

Figure 4:
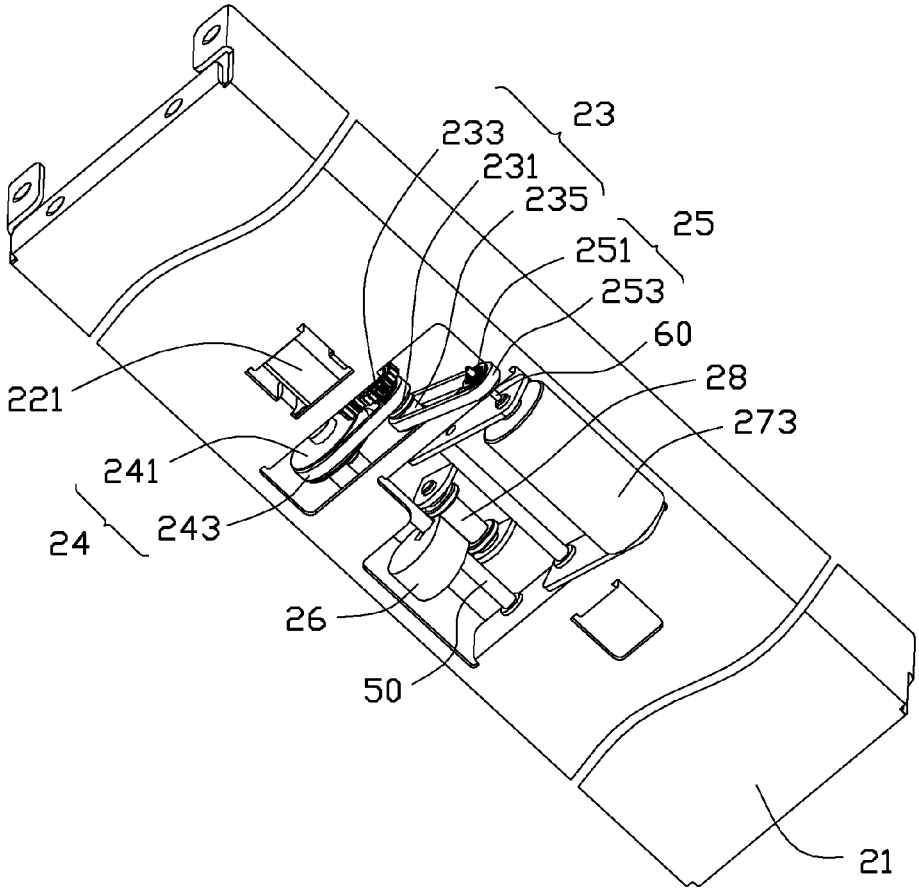
FIG. 4 is similar to FIG. 3, but viewed from a different aspect.

Referring to FIG. 4, the transfer member 23 includes an intermediate gear 231, a first main gear 233, and a second main gear 235. The intermediate gear 231, the first main gear 233 and the second main gear 235 are connected together with a second shaft 60. The first main gear 233 meshes with the first driving gear member 223. In one embodiment, the first main gear 233 has a diameter exceeding that of the second main gear 235.

The first gear assembly 24 includes a first active gear 241 and a first belt 243. The first active gear 241 is secured to a first shaft 50, and adjacent to the first driving gear member 223. See FIG. 3, the first active gear 241 is located between the second flange 217 and the second retaining piece 219. The first belt 243 surrounds the first active gear 241, and the intermediate gear 231.

The second gear assembly 25 includes a second active gear 251 and a second belt 253. The second belt 253 surrounds the second active gear 251, and the second main gear 235. In one embodiment, a diameter of the second active gear 251 is equal to that of the second main gear 235, but less than that of the first active gear 241.

The rotatable member 26 is rotatably secured to the center of the first shaft 50.

The moving member 27 includes a moving portion 271 and a roller 273. The moving portion 271 includes a first portion 2711 and a second portion 2713 that is larger than the first portion 2711. Two flanges 2714 are disposed on two opposite edges of the first portion 2711. A receiving member 28, located between the two flanges 2714, is configured for receiving the rotatable member 26. The second portion 2713, located between the second flange 217 and the second retaining piece 219, includes two parallel side panels 2716 secured to the second shaft 60. The roller 273 is movably secured to the moving portion 271, with a third shaft 61 passing through the second active gear 251 and the two side panels 2716. A resilient component 70 is arranged between the first retaining piece 218 and the first flange 216. The resilient component 70 is used to firmly engaged the rotatable member 26 with the receiving member 28, which accordingly moves up or down relative to the box 21 when the rotatable member 26 rotates the receiving member 28.

Figure 5:
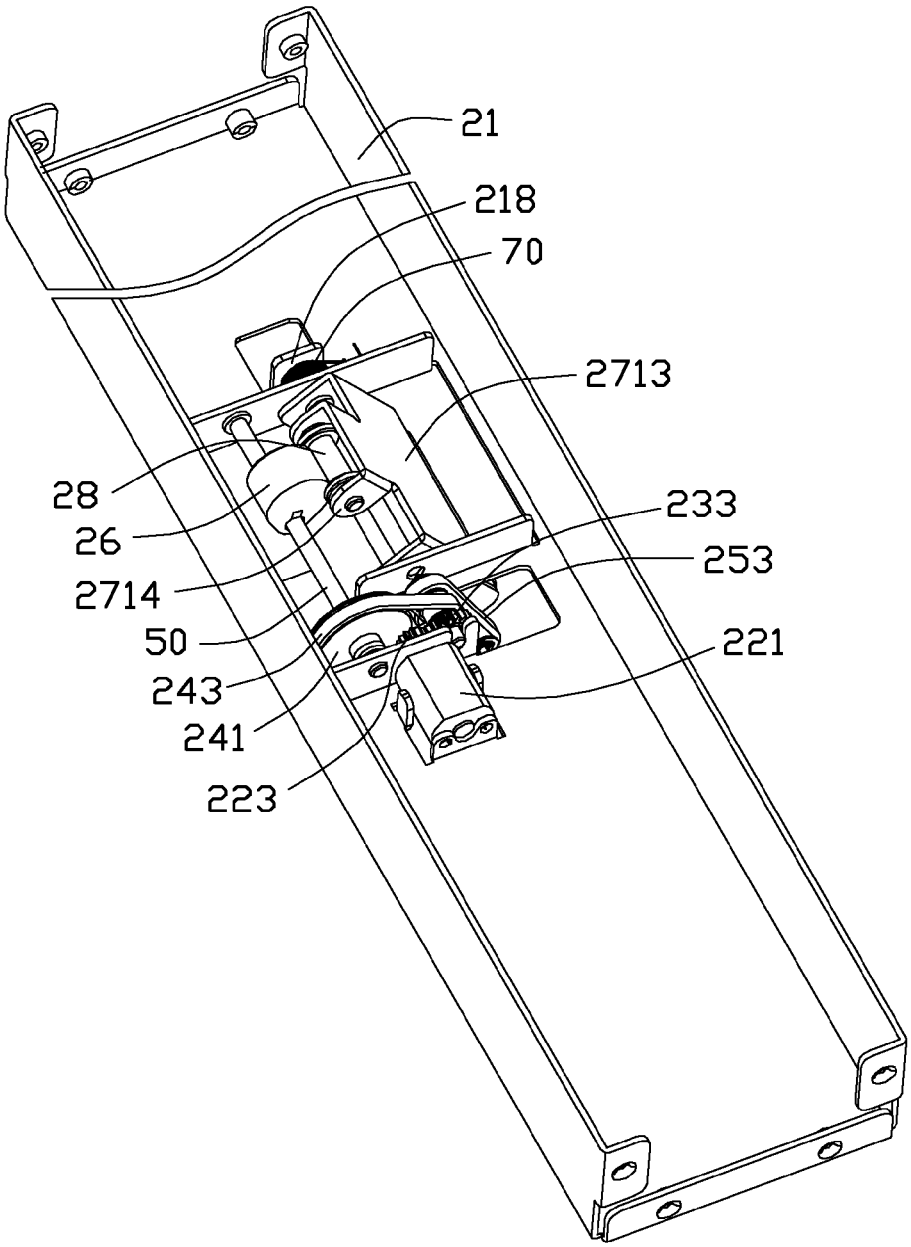
FIG. 5 is another isometric view of the adjustable mechanism of FIG. 2, but shows the moving member in a second position.
Figure 6:
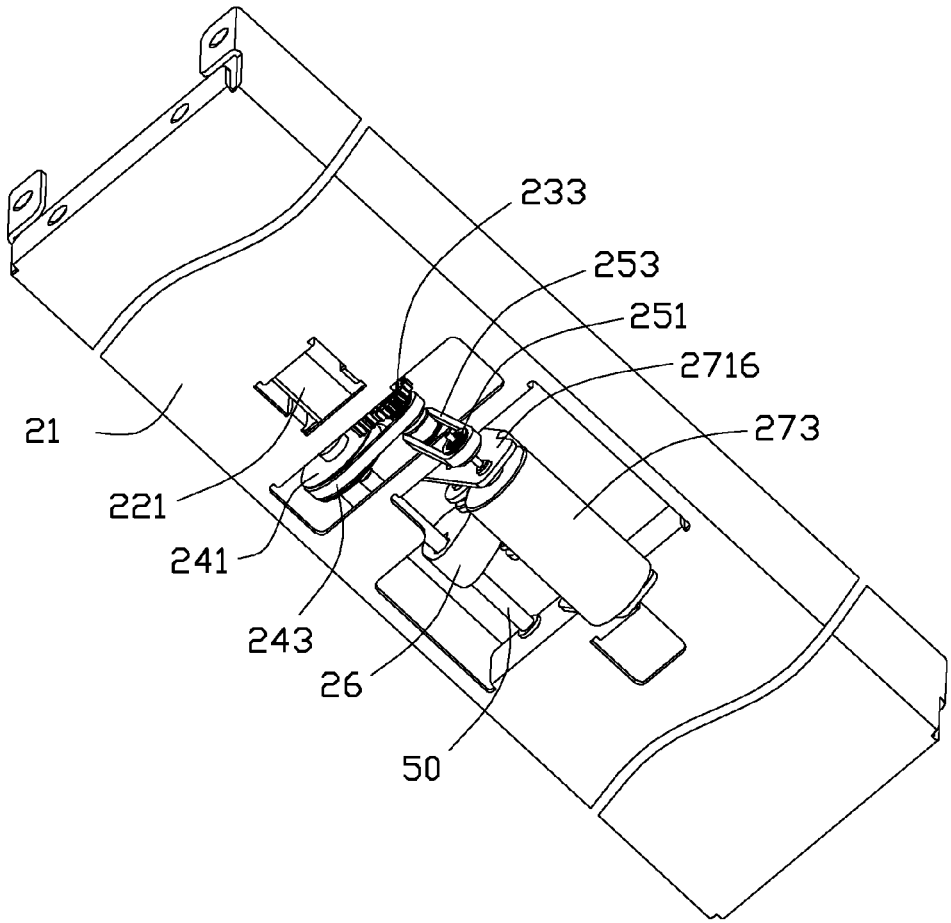
FIG. 6 is similar to FIG. 5, but viewed from a different aspect.

Referring to FIGS. 5-6, the first motor 221, can start the first driving gear member 223 moving to rotate the transfer member 23. When the transfer member 23 is rotated, the first belt 243 and the second belt 253 are moved by the transfer member 23, thereby rotating the first active gear 241 and the second active gear 251.

When the first active gear 241 is rotated and the first belt 243 is rotated, so that the first shaft 50 and the rotatable member 26 are rotated. When the rotatable member 26 rotates, the rotatable member 26 causes movement of the moving member, because the rotatable member 26 drives the receiving member 28.

When the second active gear 251 is rotated to move the second belt 253, the roller 273 is rotated.

Referring to FIG. 2, the binding mechanism 30 is used to bind printed material received in a carrier 31. A fixing post 311, having a hole (not shown), is located on the carrier 31, corresponding to a fixing hole 133 of the side panel 13. A threaded hole (not shown) is defined in the carrier 31, corresponding to one of the fastening holes 153. Four retaining holes 3131 are defined in the carrier 31. In one embodiment, the binding mechanism 30 is an automatic stapler, and has a binding portion 32.

Figure 7:
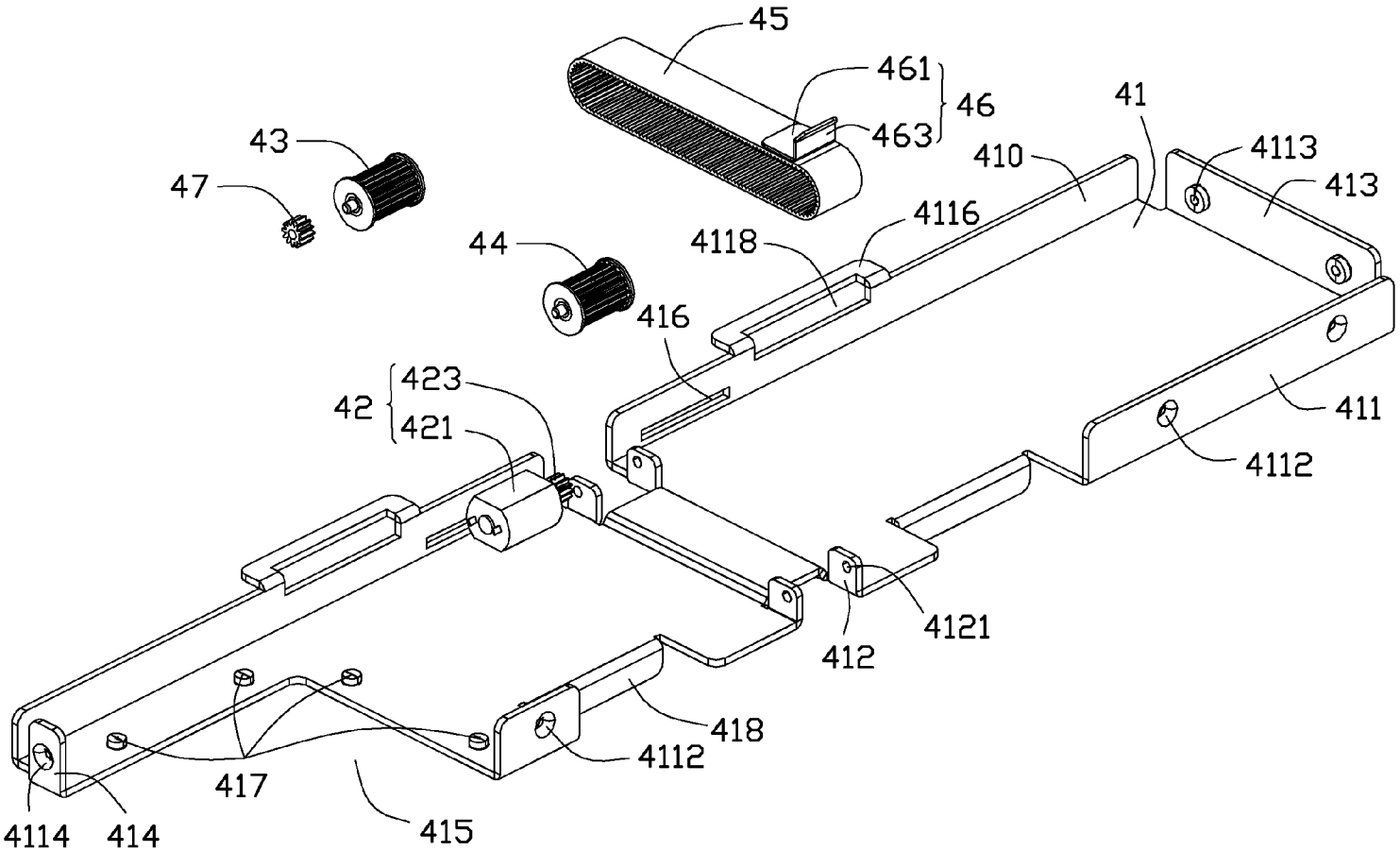
FIG. 7 is an exploded, isometric view of a transmission mechanism of FIG. 2.
Figure 8:
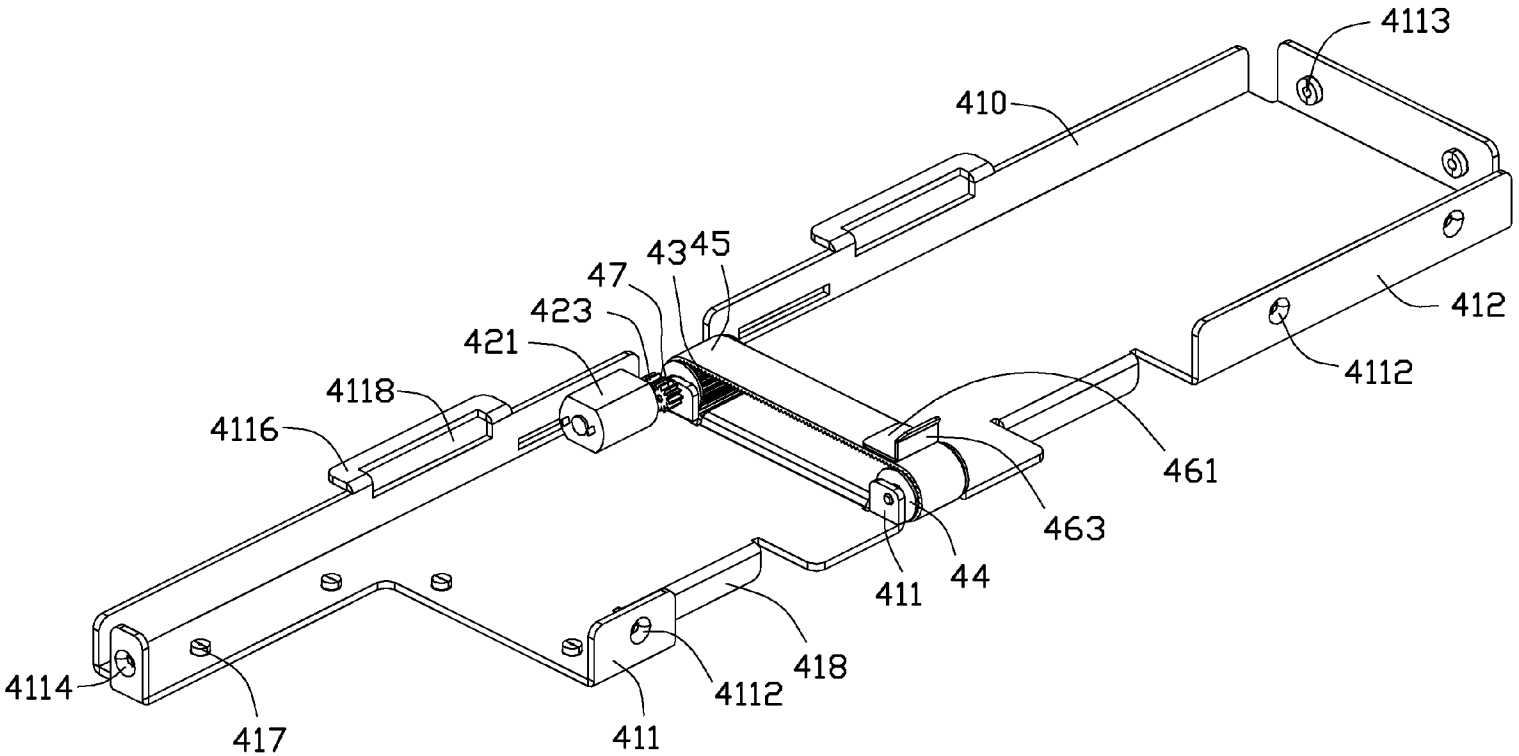
FIG. 8 is an assembled view of FIG. 7.

Referring to FIGS. 1, 7 and 8, the transmission mechanism 40 includes a mounting plate 41, a second driving device 42, a first gear wheel 43, a second gear wheel 44, a third belt 45 encircling the first and second gear wheels 43, 44, and a middle gear wheel 47 meshing with the second driving device 42 and the first gear wheel 43.

A first edgefold 410 and a second edgefold 411 are connected to two long opposite edges of the mounting plate 41, and a third edgefold 413 and a fourth edgefold 414 are connected to two opposite short edges of the mounting plate 41. Two extending pieces 4116 with two clipping holes 4118 extend from an upper edge of the first edgefold 410. Two clasping holes 416 are defined in the first edgefold 410, located between the two extending pieces 4116. In one embodiment, the two extending pieces 4116 are substantially perpendicular to the first edgefold 410. Three locking holes 4112 are defined in the second edgefold 411, corresponding to three of the fastening holes 153. Two stopper pieces 418 are connected to the mounting plate 41 and near the second edgefold 411. The two stopper pieces 418 immobilize the printed material. Some securing posts 4113, 4114 with holes (not labeled) are disposed on the third and the fourth edgefolds 413, 414, corresponding to the fixing holes 133. Two pairs of positioning pieces 412 are located in the center of the mounting plate 41, and a pivot hole 4121 is defined in each positioning piece 412. A notch 415 is defined on a side of the mounting plate 41, for receiving the binding mechanism 30. Four fastening posts 417 with holes (not labeled), that are adjacent to the notch 415, correspond to the four retaining holes 3131.

The second driving device 42 includes a second motor 421 and a second driving gear member 423 meshing with the middle gear wheel 47. The second motor 421 is used to start the second driving gear member 423, so the middle gear wheel 47 can be rotated.

A pusher 46, attached to the third belt 45, includes a securing portion 461 mounted on the third belt 45 and a pushing portion 463 connected to the securing portion 461. In one embodiment, a flange (not labeled) is arranged on an upper edge of the pushing portion 463, and the pushing portion 463 is substantially perpendicular to the securing portion 461.

Referring to FIGS. 1 and 7, the printed material tray 100 includes a principal part 103 and two side plates 105 connected to two long opposite edges of the principal part 103. A curved indentation 1031 is defined in the first end of the principal part 103, configured for removing printed material from the printed material tray 100. Two first claws 101 and two second claws 102 between the two first claws 101 are disposed on the second end of the principal part 103. The first claws 101 are received in the two clipping holes 4118. The second claws 102 are received in the two clasping holes 416. Each first claw 101 includes a first connecting portion 1011 and a first clawing portion 1013 connected to the first connecting portion 1011. Each second claw 102 includes a second connecting portion 1021 and a second clawing portion 1023 connected to the second connecting portion 1021. In one embodiment, the first connecting portion 1011 is substantially parallel to the principal part 103, and the second connecting portion 1021 is substantially perpendicular to the principal part 103. A curved guiding portion 1051 is disposed on an end of each side plate 105, adjacent to each first claw 101.

Referring to FIGS. 1-3, in assembly, the first driving gear member 223 of the first driving device 22 meshes with the first main gear 233 of the transfer member 23. The first belt 243 surrounds the first active gear 241 and the intermediate gear 231. The first active gear 241 and the rotatable member 26 are secured on the first shaft 50, and the first shaft 50 is rotatably secured between the first and second flanges 216, 217. The moving member 27 is moveably secured between the first flange 216 and the second retaining piece 219. The second belt 253 encircles the second main gear 235 and the second active gear 251. The adjustable mechanism 20 is received in the bracket 10. The mounting holes 2112 are aligned with the securing holes 131, a number of fixing members 80 are received in the mounting holes 2112 and the securing holes 131, and the adjustable mechanism 20 is thus secured in the bracket 10.

Referring to FIGS. 1, 7 and 8, the third belt 45 surrounds the first gear wheel 43 and the second gear wheel 44. The first and second gear wheels 43, 44 are rotatably located on the two pairs of the positioning pieces 412. The binding mechanism 30 is placed in the carrier 31, and the carrier 31 is received in the notch 415. The retaining holes 3131 are aligned with the holes of the fastening posts 417. A number of first mounting components 81 are received in the retaining holes 3131 and the holes of the fastening posts 417, to mount the binding mechanism 30 to the transmission mechanism 40.

The transmission mechanism 40 is placed below the adjustable mechanism 20. Some fixing holes 133 of the two side panels 13 are aligned with holes of the securing posts 4113, 4114. Some second mounting components 84 are received in the fixing holes 133 and the holes of the securing posts 4113, 4114. One of the fixing holes 133 is aligned with the hole of the fixing post 311, and a fastener (not labeled) is received in the fixing hole 133 and the hole of the fixing post 311, to secure the carrier 31 to the side panel 13. The locking holes 4112 are aligned with the fastening holes 153. Some securing components (not shown) are received in the locking holes 4112 and the fastening holes 152, and the transmission mechanism 40 is secured to the bracket 10. Then, the stopper pieces 418 are located below the gap 151, so the stopper pieces 418 do not block printed material output from the gap 151.

Referring to FIG. 1, each first clawing portion 1013 are clipped into the clipping holes 4118. Each second clawing portion 1023 are clipped into the clasping holes 416. Therefore, the printed material tray 100 is secured to the transmission mechanism 40.

Figure 9:
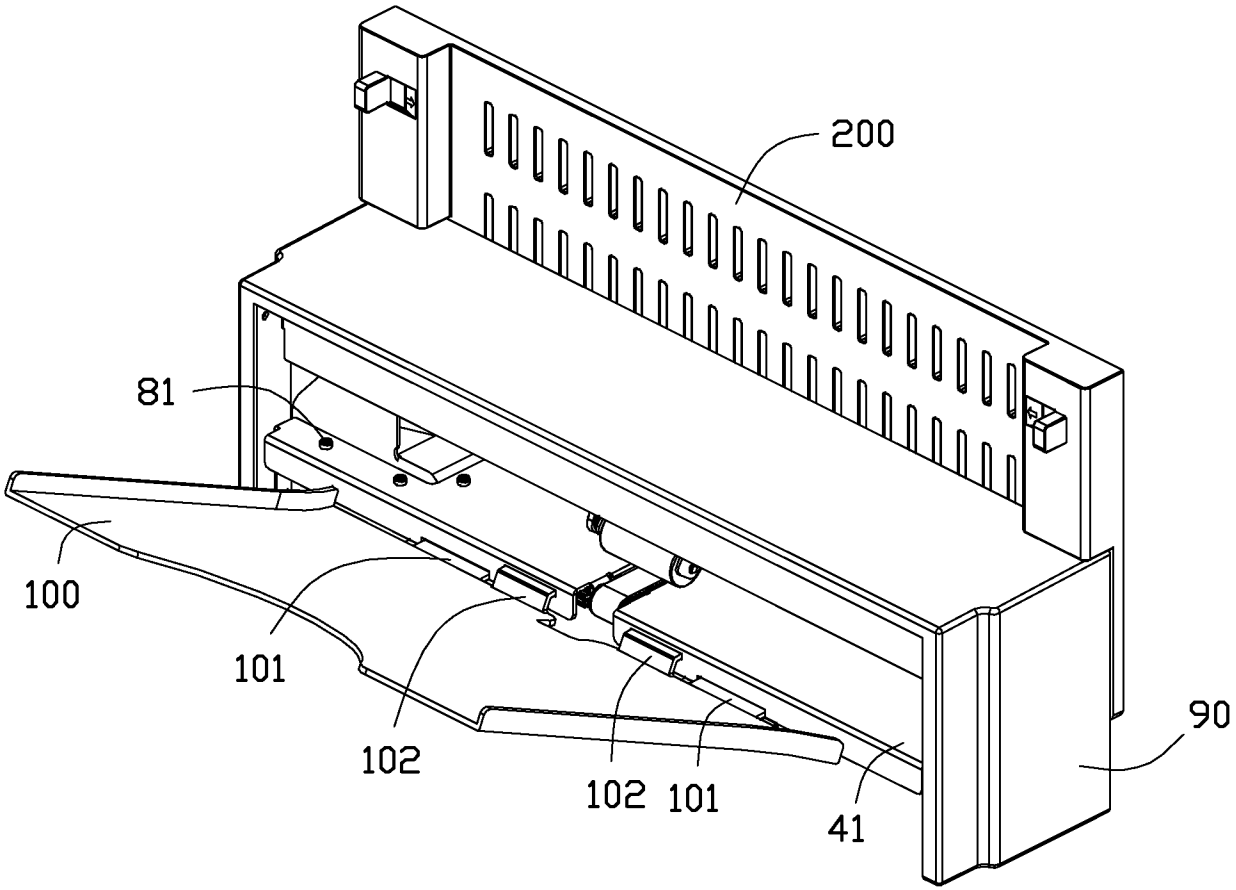
FIG. 9 is an assembled view of the printed material holding device of FIG. 2.
Figure 10:
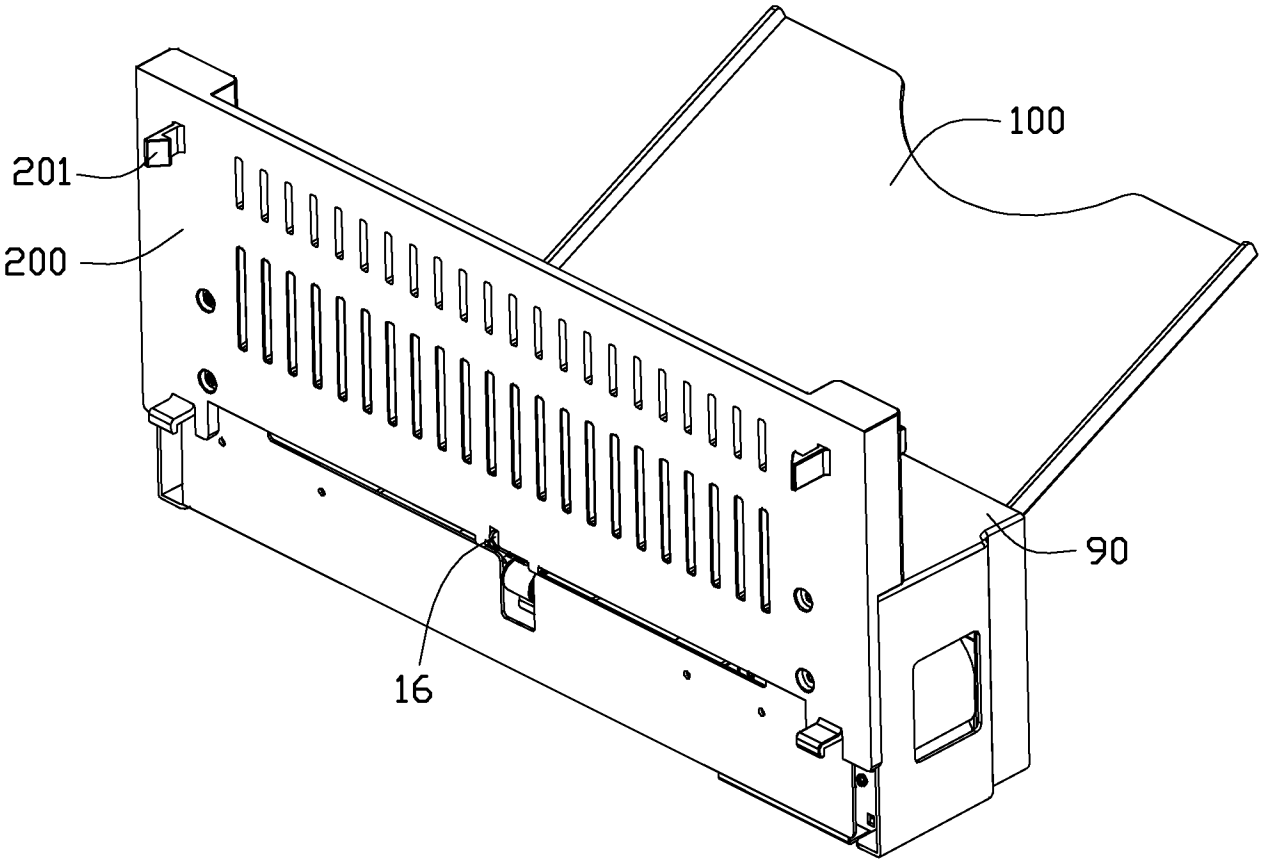
FIG. 10 is similar to FIG. 9, but viewed from a different aspect.
Figure 11:
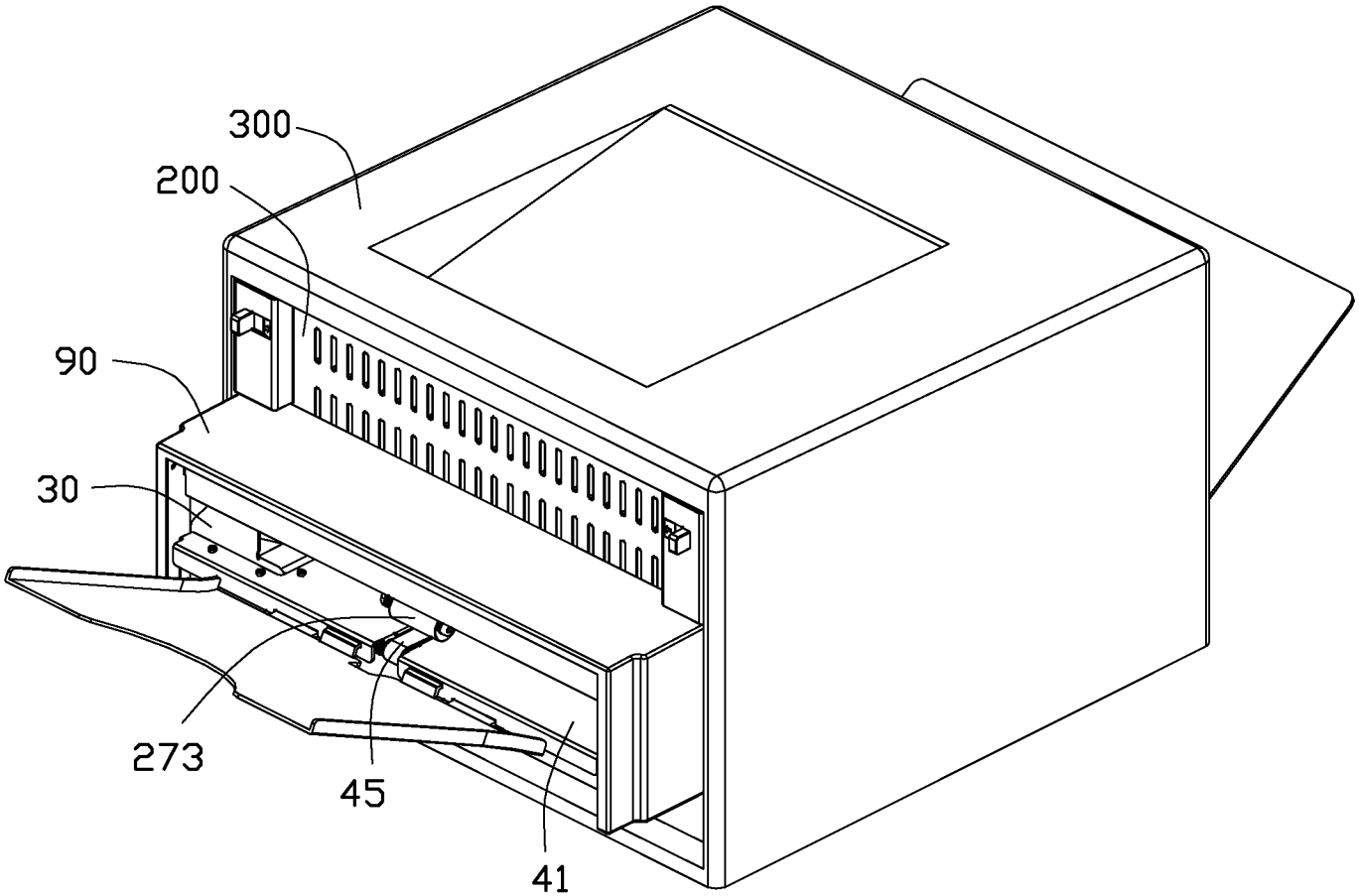
FIG. 11 is an assembled view of the printer of FIG. 1.

Referring to FIGS. 9 and 10, the bracket 10 is received in the receiving tray 90, and the receiving tray 90 is secured to the mounting member 200. The catches 201 are clipped into the rear wall of the main body 300, and the gap 151 is aligned with the output opening 301 of the main body 300.

Referring to FIGS. 3-7, the moving member 27 can be periodically rotated between a first position and a second position. In the first position, the short radius portion of the rotatable member 26 abuts the receiving member 28, and the roller 273 of the moving member 27 is located downward away from the first and second flanges 216, 217 (shown in FIGS. 3-4). In the second portion, the long radius portion of the rotatable member 26 abuts the receiving member 28, and the roller 273 of the moving member 27 is located upward adjacent to the first and second flanges 216, 217 (shown in FIGS. 5-6). The pusher 46 on the third belt 45 can move between a first state and a second state. In the first state, the roller 273 is rotated to the first position, near the mounting plate 41 of the transmission mechanism 40, and the pusher 46 is located below the mounting plate 41. In the second state, the roller 273 is rotated to the second position, away from the mounting plate 41, and the pusher 46 is located above the mounting plate 41 (shown in FIG. 8).

In use, the moving member 27 is originally located in a first position, and the pusher 46 on the third belt 45 is originally located in a first state. Printed material is output from the output opening 301 and passes through the gap 151 to the printed material tray 100. If the sensor 16 detects movement of the media, the sensor 16 immediately starts the adjustable mechanism 20. At this time, the first motor 221 rotates the first driving gear member 223, so the transfer member 23 is rotated with the first driving gear member 223. When the transfer member 23 is rotated, the first active gear 241 and the second active gear 251 are synchronously rotated. The first belt 243 and the second belt 253 are rotated, to rotate the first shaft 50 and the rotatable member 26. Therefore, the first shaft 50 and the rotatable member 26 can rotate the moving member 27. When the first shaft 50 and the rotatable member 26 rotate the moving member 27 to the second position, an aperture is formed between the roller 273 and the mounting plate 41 through which the printed material can pass. At the same time, the roller 273 is continually rotated by the second gear assembly 25.

When the first shaft 50 and the rotatable member 26 rotate the moving member 27 to the first position, the roller 273 moves near the mounting plate 41 and abuts the media, moving the printed material near the gap 151. The printed material is thus aligned with the binding portion 32. Then, the first driving device 22 further rotates the moving member 27 to the second position, awaiting subsequent printed material output from the output opening 301.

Printed material is output from the output opening 301 to the adjustable mechanism 20 aligning with the media. When a file including multiple printed material, is placed in order, the sensor 16 starts the binding mechanism 30 to bind the file. When the file is bound, the sensor 16 starts the transmission mechanism 40. Then, the second motor 421 rotates the second driving gear member 423. So, the middle gear wheel 47 can be rotated with the second driving gear member 423 and simultaneously rotate the first gear wheel 43. At this time, the third belt 45 and the second gear wheel 44 are rotated with the first gear wheel 43. Therefore, the pusher 46 is rotated to the second state, until the pushing portion 463 of the pusher 46 abuts an edge of the file bound by the binding mechanism 30. The third belt 45 and the second gear wheel 44 go on rotating, and the pushing portion 463 move the file away from the mounting plate 41, until the file is placed in the printed material tray 100. Then, the second driving device 42 stops working, awaiting a subsequent file bound by the binding mechanism 30.

It is to be understood, however, that even though numerous characteristics and advantages have been set forth in the foregoing description of embodiments, together with details of the structures and functions of the embodiments, the disclosure is illustrative only and changes may be made in detail, especially in matters of shape, size, and arrangement of parts within the principles of the disclosure to the full extent indicated by the broad general meaning of the terms in which the appended claims are expressed.

What is claimed is:

1. A printed material holding device comprising:

a printed material tray for receiving printed material, comprising a first claw and a second claw;

a transmission mechanism comprising a mounting plate, the mounting plate is attached to a main body of a printer, and a clipping hole and a clasping hole defined in the mounting plate;

wherein the first claw is configured to move between a first configuration, where the first claw is engaged in the clipping hole in a first direction, the second claw is engaged in the clasping hole in a second direction opposite to the first direction, so that printed material tray is secured to the mounting plate, and a second configuration, where the first claw is disengaged from the clipping hole, the second claw is disengaged from the clasping hole, so that the printed material tray is withdrawn from the mounting plate.

2. The printed material holding device of claim 1, wherein the first claw comprises a first connecting portion and a clawing portion connected to the first connecting portion, and the clawing portion is substantially perpendicular to the first connecting portion.

3. The printed material holding device of claim 1, wherein a first edgefold is connected to the mounting plate, and the clasping hole is defined in the first edgefold.

4. The printed material holding device of claim 3, wherein an extending piece is connected to the first edgefold, and the clipping hole is defined between the extending piece and the first edgefold.

5. The printed material holding device of claim 1, wherein the printed material tray comprises a principal part, and the first and second claws are disposed on an edge of the principal part.

6. The printed material holding device of claim 5, wherein the second claw comprises a second connecting portion, and the second connecting portion is substantially perpendicular to the principal part.

7. The printed material holding device of claim 5, wherein the printed material tray comprises two side plates connected to two opposite edges of the principal part, and a guiding portion is disposed on each side plate.

8. The printed material holding device of claim 5, wherein an indentation is defined in an end of the principal part, and the indentation is curved.

9. A printer comprising:

a main body, configured for printing and outputting printed material, comprising an outputting opening defined in the main body; and a printed material holding device comprising:

a mounting member attached to the main body;

a bracket secured to the mounting member, and a gap defined in the bracket, being aligned with the outputting opening;

a printed material tray, for receiving the printed material from the gap, comprises a first claw;

a transmission mechanism received in the bracket, comprising a mounting plate, the mounting plate secured to the bracket, and a clipping hole defined in the mounting plate;

wherein the first claw is configured to move between a first configuration, where the first claw is received in the clipping hole, so that the printed material tray is secured to the mounting plate, and a second configuration, where the first claw is withdrawn from the clipping hole, so that the printed material tray is removed from the mounting plate.

10. The printer of claim 9, wherein the first claw comprises a first connecting portion and a clawing portion connected to the first connecting portion, and the clawing portion is substantially perpendicular to the first connecting portion.

11. The printer of claim 9, wherein a second claw is located on the printed material tray, a clasping hole is defined in the mounting plate, and the second claw is received in the clasping hole, when the first claw is located in the first configuration.

12. The printer of claim 11, wherein a first edgefold is connected to the mounting plate, and the clasping hole is defined in the first edgefold.

13. The printer of claim 12, wherein an extending piece is connected to the first edgefold, and the clipping hole is defined between the extending piece and the first edgefold.

14. The printer of claim 11, wherein the printed material tray comprises a principal part, and the first and second claws are disposed on an edge of the principal part.

15. The printer of claim 14, wherein the second claw comprises a second connecting portion, and the second connecting portion is substantially perpendicular to the principal part.

16. The printer of claim 14, wherein the printed material tray comprises two side plates connected to two opposite edges of the principal part, and a guiding portion is disposed on each side plate.

17. The printer of claim 14, wherein an indentation is defined in an end of the principal part, and the indentation is curved.

* * * * *